United States Patent [19]

Kulzer et al.

[11] Patent Number: 4,634,005

[45] Date of Patent: Jan. 6, 1987

[54] PACKAGE AND METHOD FOR USE IN DISPLAYING MERCHANDISE FOR SALE

[75] Inventors: Darrell A. Kulzer, Denver; Martin L. Rohm, Aurora, both of Colo.

[73] Assignee: B & R Plastics, Inc., Denver, Colo.

[21] Appl. No.: 758,676

[22] Filed: Jul. 25, 1985

[51] Int. Cl.[4] ..... B65D 75/56

[52] U.S. Cl. ..... 206/477; 206/349; 206/470; 206/480; 206/495; 211/70.6

[58] Field of Search ..... 206/349, 361, 370, 371, 206/376, 461, 449, 467, 470, 471, 477, 485, 480–483, 488, 495; 211/70.6

[56] References Cited

U.S. PATENT DOCUMENTS

| | | | |
|---|---|---|---|
| 3,423,059 | 1/1969 | Kahn | 206/480 |
| 3,927,765 | 12/1975 | Beal | 206/482 |
| 4,069,915 | 1/1978 | Schurman | 206/477 |
| 4,228,896 | 10/1980 | Wu | 206/482 |
| 4,378,068 | 3/1983 | Bell | 206/470 |
| 4,450,961 | 5/1984 | Bies et al. | 206/480 |
| 4,531,636 | 7/1985 | Salacuse | 206/477 |

*Primary Examiner*—William Price
*Assistant Examiner*—Jimmy G. Foster
*Attorney, Agent, or Firm*—Klaas & Law

[57] ABSTRACT

A package for use in displaying merchandise on a display stand wherein the merchandise is securely attached to the package and wherein the merchandise may be actually grasped and felt by the potential purchaser who may even simulate the use of the merchandise.

11 Claims, 3 Drawing Figures

PACKAGE AND METHOD FOR USE IN DISPLAYING MERCHANDISE FOR SALE

FIELD OF THE INVENTION

This invention relates generally to the marketing of merchandise to be sold so that the merchandise may be attractively displayed, conveniently stored and easily identified and more particularly to the marketing of tools as durable packages that may be readily displayed, conveniently stored and easily identified.

BACKGROUND OF THE INVENTION

Many manufacturers market merchandise to retailers in packages which allow the retailers to display the merchandise on a plurality of hooks extending outwardly from a surface of a support. These packages have many different forms. One package comprises a flexible plastic bag in which the merchandise is contained which plastic bag is secured to a cardboard holder having an opening so that it may be readily positioned over a hook. Another type of packages comprises vacuum forming the merchandise onto an air pervious section of cardboard and providing an opening so that the article may be readily positioned on a hook. One of the problems associated with the foregoing packages for marketing merchandise is that the packaged merchandise cannot be really handled and felt by the purchaser. This is particularly important in the marketing of tools, such as a hammer, whereby it would be desirable for the purchaser to be able to grasp the handle and know how the hammer was going to feel when in use. Another problem associates with the foregoing packages relates to the packaging of relatively heavy articles such as tools. It is not unusual for several potential purchasers to remove a packaged merchandise from the display support to examine the merchandise more closely and then return the merchandise to the display support. When the merchandise is relatively heavy, there is a tendency for the cardboard to be damaged to an extent that the package can no longer be mounted on the display support hook.

BRIEF DESCRIPTION OF THE INVENTION

This invention relates to a package and method for marketing merchandise so that it may be attractively displayed, conveniently stored and easily identified and at the same time be readily available to the purchaser so that he can physically grasp the merchandise and feel it and even simulate the use of the merchandise. In a preferred embodiment of the invention, the package is used in the marketing of tools, such as a hammer, and is manufactured as an integrally molded product from a plastic material that when cured is relatively rigid and durable.

In a preferred embodiment of the invention, the package comprises a plate having a front surface and a rear surface. A pair of spaced apart projections extend outwardly from the front surface so as to form an opening so that a portion of the merchandise, such as a portion of the handle of a hammer, may be positioned between the projections. A tab extends outwardly from one of the projections and has a length such that it may be secured in a locking arrangement to the other of the projections. The cross-sectional area enclosed by the front surface, the projections and the tab when in the secured position is smaller than the crosssectional areas of portions of the merchandise to be sold located both above and below the tab so that the merchandise cannot be readily separated from the package. An opening is provided in the plate at a location spaced from the projections as that the packaged merchandise may be displayed by mounting the package on display hook.

It is an object of this invention to provide a package and method for use in marketing merchandise wherein the merchandise may be attractively displayed and may be physically grasped and felt by the purchaser and even simulate the use of the merchandise.

It is another object of this invention to provide a package and method for use in marketing relatively heavy merchandise wherein the merchandise may be attractively displayed but which package is relatively rigid and durable so that it may be repeatedly removed from and returned to a display hook without deterioration.

Additional objects, advantages, and novel features of the invention are set forth in part in the description which follows which will be understood by those skilled in the art upon examination of the following or may be learned by practice of the invention. The objects and advantages of the invention may be realized an obtained by means of the instrumentalities and combinations particularly pointed out in the appended claims.

DETAILED DESCRIPTION OF THE DRAWING

Figure 1:
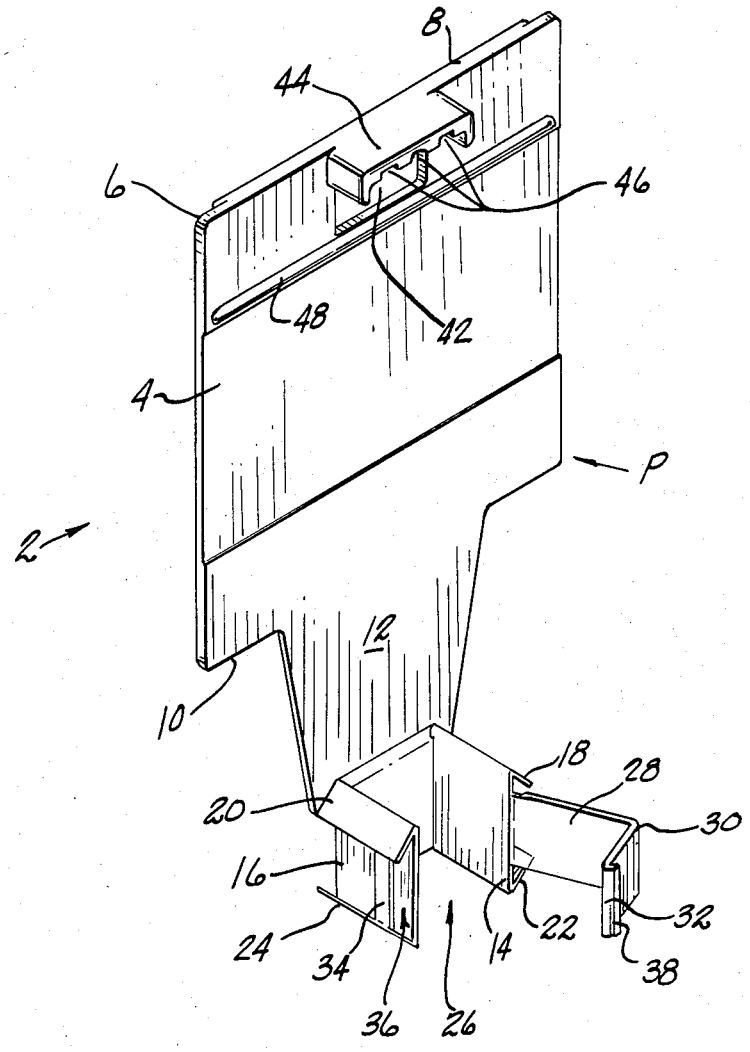
FIG. 1 is a pictorial view of a package of this invention in an open position.

In FIG. 1, there is illustrated one of the preferred embodiments of the invention and comprises a package P comprising a plate 2 having a front surface 4 and a back surface 6. The plate 2 has a top edge 8 and a bottom edge 10. A central portion 12 extends from the bottom edge 10.

A pair of projections 14 and 16 extend outwardly from the central portion 12 in a direction substantially perpendicular thereto. Each of the projections 14 and 16 is provided with an upper strengthening flange 18 and 20 and a lower strengthening flange 22 and 24. The projections 14 and 16 are spaced apart so as to form an opening 26. The size of the opening 26 between the projections 14 and 16 will vary with the size being determined by the merchandise to be displayed by the package.

Figure 3:
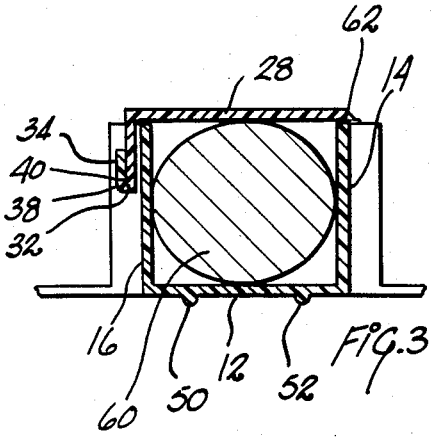
FIG. 3 is a cross-sectional view along the line 3—3 of FIG. 2.

A tab 28 extends outwardly from the projection 14 between the strengthening flanges 18 and 22 and has a right angled bend 30 formed therein. A lip 32 is formed on the end of the tab 28. A strap 34 extends between and is integral with the strengthening flanges 20 and 24. When the package P is in a closed position, as illustrated in FIG. 3, the lip 32 has been pushed through the opening 36 between the strap 34, the outer surface of the projection 16 and the inner surfaces of the flanges 20 and 24 until the edge 38 of the lip 32 is in contact with the edge 40 of the strap 34. In the preferred embodiment of the invention, the thickness of the lip 32 is slightly greater than the distance between the strap 34 and the opposed portion of the outer surface of the projection 16 so that the lip 32 is positively retained in the locked position. There is sufficient resiliency in the surround structure to permit to be pushed through the opening 36 until it is in the locked position illustrated in FIG. 3.

An opening 42 is made in the plate 2 adjacent to the top edge 8. A flange 44 projects outwardly from the front surface 4 adjacent to the edge of the opening closest to the top edge 8. The flange 44 is provided with a plurality of grooves 46 to cooperate in placing the package P on a display hook (not shown). The plate 2 may be provided with reinforcing ribs in various areas such as the reinforcing ribs 48, 50 and 52.

Figure 2:
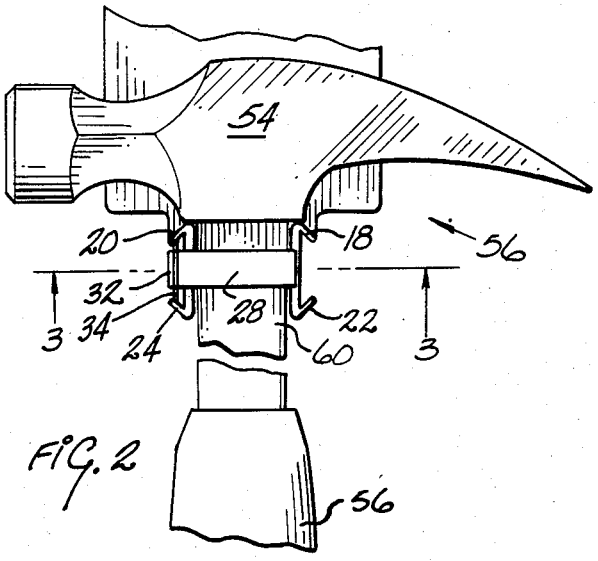
FIG. 2 is a front elevation of a modification of the package of this invention in a closed position around the handle of a hammer.

The package P illustrated in FIG. 2 is substantially the same as that illustrated in FIG. 1 with the only difference being the relative size and shape of the central portion 12. In FIG. 2, the tab 28 is in the locked position. As illustrated in FIG. 2, the cross-sectional area defined by the inner surfaces of the central portion 12, the projection 14, the tab 28 and the projection 16 is smaller than the cross-sectional area of the head 54 of the hammer 56 and the holding portion 58 of the handle 60 so that the hammer cannot be removed from the package.

In the preferred embodiments of the invention, the package P is integrally molded using a high density plastic material such as polypropylene or other similar materials. The package has a generally uniform thickness in the range from about 1.0 mm to 3.0 mm. As stated above, the relative sizes of the various sections of the package may be varied so as to accommodate different articles of merchandise. For example, in the package P illustrated in FIG. 1, the plate 2 has a length from top edge 8 to bottom edge 10 of about 10 cm, a width of about 9.2 cm, the central portion 12 extends from the bottom edge 10 for a distance of about 6.4 cm and has an average width of about 4.4 cm, the projections 14 and 16 extend outwardly for a distance of about 2.0 cm and the size of the opening 26 is about 2.4 cm. In the package P illustrated in FIG. 2, the plate 2 has a length from top edge 8 to bottom edge 10 of about 9.8 cm, a width of about 9.2 cm, the central portion 12 extends from the bottom edge 10 for a distance of about 3.0 cm and has a width of about 5.0 cm, the projection 14 and 16 extend outwardly for a distance of about 2.4 cm and the size of the opening 26 is about 3.5 cm.

In operation, a package P is positioned with the tab 28 in an opened position. A portion of the article of merchandise to be packaged, such as the hammer 56 in FIG. 2, is placed through the opening 26 to position between the projections 14 and 16. The tab 28 is then closed by pushing the lip 32 through the opening 36 until the lip 32 is in a locked position with the edge 38 of the lip 32 in contact with the edge 40 of the strap 34. In order to facilitate the flexing of the tab 28, a living hinge 62 is formed at the junction of the tab 28 and the projection 14.

It is contemplated that the inventive concepts herein described may be variously otherwise embodies and it is intended that the appended claims be construed to include alternative embodiments of the invention except insofar as limited by the prior art.

What is claimed is:

1. A package for use in displaying merchandise in a condition for sale comprising:

a plate having a relatively large surface area and having a front surface and a rear surface;

a pair of spaced apart projections extending outwardly from said front surface;

an opening between said spaced apart projections so that a portion of the merchandise may be moved through said opening to a position between said projections and adjacent to said front surface;

means for locking said means for closing said opening in a position wherein said opening is closed;

means for closing said opening so that said merchandise cannot be readily separated from said plate comprising:

an integral tab extending from one of said projections and having a length greater than the width of said opening between said projections;

means for locking the end of said integral tab to the other of said projections;

a pair of opposed flanges on each of said projections for strengthening each of said projections and said flanges being integral therewith; and said flanges extending from each of said projections so as to form an included acute angle.

2. A package as in claim 1 wherein said locking means comprises:

a strap extending between and secured to each of said flanges adjacent to the end of said other of said projections;

said strap being spaced a distance from said other of said projections;

a lip on the end of said integral tab; and at least a portion of said lip having a thickness greater than the distance between said strap and said other projection.

3. A package as in claim 2 and further comprising:

said strap and said flanges having sufficient resiliency to permit said lip to be passed therethrough, but to resile to a position substantially preventing the removal of said lip.

4. A package as in claim 3 and further comprising:

means adjacent the juncture of said tab and said one projection permitting flexing of said tab.

5. A package as in claim 3 and further comprising:

each of said projections having an inner surface and an outer surface;

said inner surfaces facing each other and being generally planar;

said flanges being located adjacent to each of said outer surfaces; and the portion of each of said outer surfaces between said flanges being generally planar.

6. A package as in claim 5 and further comprising:

said strap extending in a direction generally parallel to said outer surface of said other projection; and said lip extending in a direction generally parallel to said outer surface of said other projection and to said strap when in the locked position.

7. A package as in claim 6 and further comprising: all of said lip having a thickness greater than the distance between said strap and said other project.

8. A package as in claim 6 and wherein:

a major portion of said plate having a generally rectangular configuration.

9. A package as in claim 8 wherein: said plate has a top edge and a bottom edge;

a central portion of said plate extends below said bottom edge; and said pair of projections extending outwardly from the front surface of said central portion located below said bottom edge.

10. A package as in claim 9 wherein:

the cross-sectional area enclosed by said central portion of said plate, said inner surfaces of said projections and said tab when in said locked position is smaller than the cross-sectional areas of portions of the merchandise to be sold located both above and below said tab so that said merchandise cannot be readily separated from said package.

11. A package as in claim 10 and further comprising:

an opening in said plate adjacent to the central portion of said top edge; and reinforcing means adjacent at least to the portion of said opening adjacent to said top edge so that said package with said merchandise secured thereto may be supported in a location to be displayed.

* * * * *

UNITED STATES PATENT AND TRADEMARK OFFICE

CERTIFICATE OF CORRECTION

PATENT NO. : 4,634,005

DATED : January 6, 1987

INVENTOR(S) : Darrell A. Kulzer and Martin L. Rohm

It is certified that error appears in the above-identified patent and that said Letters Patent are hereby corrected as shown below:

Claim 7.

Column 4, line 57 Cancel "project" and insert therefor --projection--.

Signed and Sealed this

Seventh Day of April, 1987

*Attest:*

DONALD J. QUIGG

*Attesting Officer*

*Commissioner of Patents and Trademarks*